US008950594B2

(12) United States Patent
Moon

(10) Patent No.: US 8,950,594 B2
(45) Date of Patent: Feb. 10, 2015

(54) TRAY FOR FLAT DISPLAY PANEL

(75) Inventor: Sang-Yeon Moon, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 13/537,039

(22) Filed: Jun. 28, 2012

(65) Prior Publication Data

US 2013/0134112 A1 May 30, 2013

(30) Foreign Application Priority Data

Nov. 30, 2011 (KR) ..... 10-2011-0127256

(51) Int. Cl.
*B65D 85/86* (2006.01)

(52) U.S. Cl.
USPC ..... 211/26; 211/41.1; 211/133.6; 211/175

(58) Field of Classification Search
CPC ..... B25B 1/205; B25B 5/003; B25B 5/108; B25B 5/142; B25B 5/145; B23K 3/087
USPC ..... 211/26, 41.1, 41.14, 132.1, 126.1, 175, 211/183, 133.6; 269/10, 287, 317, 319, 269/298; 228/43, 49.5; 206/724
See application file for complete search history.

(56) References Cited

U.S. PATENT DOCUMENTS 4,759,488 A * 7/1988 Robinson et al. ..... 228/43
5,161,789 A * 11/1992 Rogers ..... 269/42
5,456,402 A * 10/1995 Curtin ..... 228/43
5,501,436 A * 3/1996 Miller ..... 269/47
5,785,307 A * 7/1998 Chung ..... 269/254 CS
5,820,013 A * 10/1998 Ortiz ..... 228/43
6,209,859 B1 * 4/2001 Chung ..... 269/111
6,799,714 B2 * 10/2004 Gleason ..... 228/212
6,986,210 B1 * 1/2006 Conway ..... 33/562
7,229,000 B2 * 6/2007 Wang et al. ..... 228/49.5
7,651,079 B2 * 1/2010 Lee et al. ..... 269/21
2005/0067463 A1 * 3/2005 Wang et al. ..... 228/37
2005/0067464 A1 * 3/2005 Wang et al. ..... 228/49.5

FOREIGN PATENT DOCUMENTS

JP 2010-120692 A 6/2010
KR 10-2005-0105598 A 11/2005
KR 10-2011-0048372 A 5/2011
KR 10-2011-0093689 A 8/2011

* cited by examiner

*Primary Examiner* — Jonathan Liu
*Assistant Examiner* — Stanton L Krycinski
(74) *Attorney, Agent, or Firm* — Christie, Parker & Hale, LLP

(57) ABSTRACT

A tray for a flat display panel. The tray includes a frame including a seating portion on which the flat display panel sits; a clamping device for clamping the panel so as not to be separated from the seating portion; and a size adjusting device for adjusting a size of the frame to correspond to a size of the panel. The tray allows the frame to be safely and firmly supported and transported, thereby greatly preventing the panel from being damaged during an examination of the panel and improving efficiency of the examination.

9 Claims, 12 Drawing Sheets

TRAY FOR FLAT DISPLAY PANEL

CROSS-REFERENCE TO RELATED PATENT APPLICATION

This application claims priority to and the benefit of Korean Patent Application No. 10-2011-0127256, filed on Nov. 30, 2011, in the Korean Intellectual Property Office, the disclosure of which is incorporated herein in its entirety by reference.

BACKGROUND

1. Field

The following description relates to a tray for supporting a flat display panel.

2. Description of the Related Art

In general, during manufacturing of a flat display panel, such as an organic light-emitting diode (OLED) panel or a liquid crystal panel, there is a need to perform an examination for examining whether the flat display panel has a defect.

So far, a flat display panel has been transferred without using additional protective equipment during the examination. However, the flat display panel is often damaged during transfer of the flat display panel. Recently, as flat display panels have become large, a flat display panel may more likely to be damaged when being transferred. In particular, since an OLED panel does not include a backlight unit, such as a liquid crystal panel, the OLED panel has relatively low rigidity, and thus, the OLED panel may be easily damaged when being transferred.

Accordingly, there is a need to develop a method of easily transferring and examining a flat display panel.

SUMMARY

An aspect of an embodiment of the present invention is directed toward a tray that enables a user to safely and effectively handle a flat display panel.

An aspect of an embodiment of the present invention is directed toward a tray capable of being effectively used to safely transport the flat display panel during handling.

According to an embodiment of the present invention, there is provided a tray for a flat display panel, the tray including: a frame including a seating portion on which the flat display panel sits; a clamping device for clamping the panel so as not to be separated from the seating portion; and a size adjusting device for adjusting a size of the frame to correspond to a size of the flat display panel.

The clamping device may include: a push lever that is rotatably installed on the frame; and a spring for providing elastic force so that the push lever presses the panel in a direction of the seating portion.

The clamping device may include: a pair of rotational blocks that are rotatably installed on the frame; a push bar connected to the rotational blocks; and a plurality of fixing fins for respectively fixing the rotational blocks when the panel is pressed in a direction of the seating portion and when the pressing of the panel is released.

The clamping device may include: a plurality of belts installed on the frame; and a fastening device for connecting the belts to the panel on a side of the panel facing oppositely away from the seating portion so that the fastening device is tightly held (adhered) to the panel.

A plurality of bumping members may be each installed at a contact portion between an edge portion of the panel and the frame.

The bumping member may include at least one selected from the group consisting of urethane and silicon.

The frame may include a plurality of pieces that connect to one another, wherein the size adjusting device may include: a plurality of slide bars that connect the pieces to allow the pieces to approach one another or to move away from one another; and a fastening device for fixing the pieces to the slide bars.

The fastening device may have a plurality of fastener holes formed in the pieces and a plurality of fasteners for inserting into the fastener holes to be compressed against and fastened with the slide bars.

A plurality of transferring rollers may be installed on at least one surface of the frame to move along a transfer rail.

A plurality of slide guides may be installed on a surface facing the transferring rollers of the frame to be slidably coupled to the transfer rail.

A connecting portion may be installed in the frame to be electrically coupled to the panel.

The tray may further include a plurality of handles on the frame.

BRIEF DESCRIPTION OF THE DRAWINGS

The above and other features and principles of the present invention will become more apparent by describing in detail exemplary embodiments thereof with reference to the attached drawings in which.

DETAILED DESCRIPTION

Now, an exemplary embodiment according to the present invention will be described in detail with reference to the accompanying drawings. Expressions such as "at least one of," when preceding a list of elements, modify the entire list of elements and do not modify the individual elements of the list.

Figure 1:
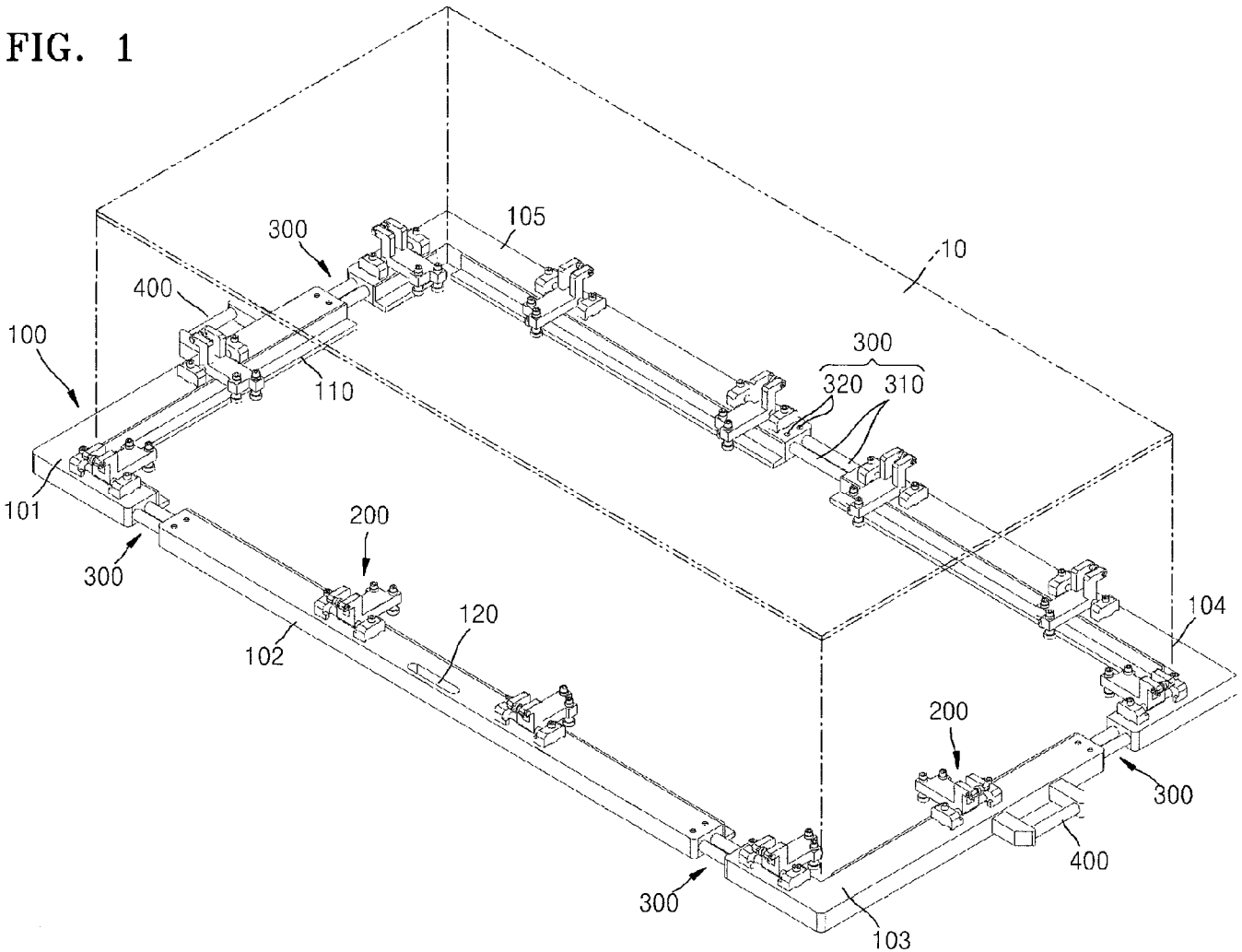
FIG. 1 is a perspective view of a tray for a flat display panel according to an embodiment of the present invention.

FIG. 1 is a perspective view of a tray for a flat display panel according to an embodiment of the present invention.

Referring to FIG. 1, the tray includes a frame 100 including a seating portion 110 on which a panel 10 is seated, a plurality of clamping devices 200 for clamping the panel 10 so as not to be separated from the seating portion 110, and a size adjusting device 300 for adjusting a size of the frame 100 to correspond to a size of the panel 10.

First, the frame 100 forms an outer frame for supporting the panel 10 and has a structure in which a plurality of pieces 101, 102, 103, 104, and 105 are connected to one another. As such, the frame 100 is formed of the plurality of pieces 101, 102, 103, 104, and 105 to adjust a size of the frame 100 by using the size adjusting device 300, which will be described below. An edge of the panel 10 is seated on and supported by the seating portion 110 disposed at an inner side of the frame 100.

Figure 2:
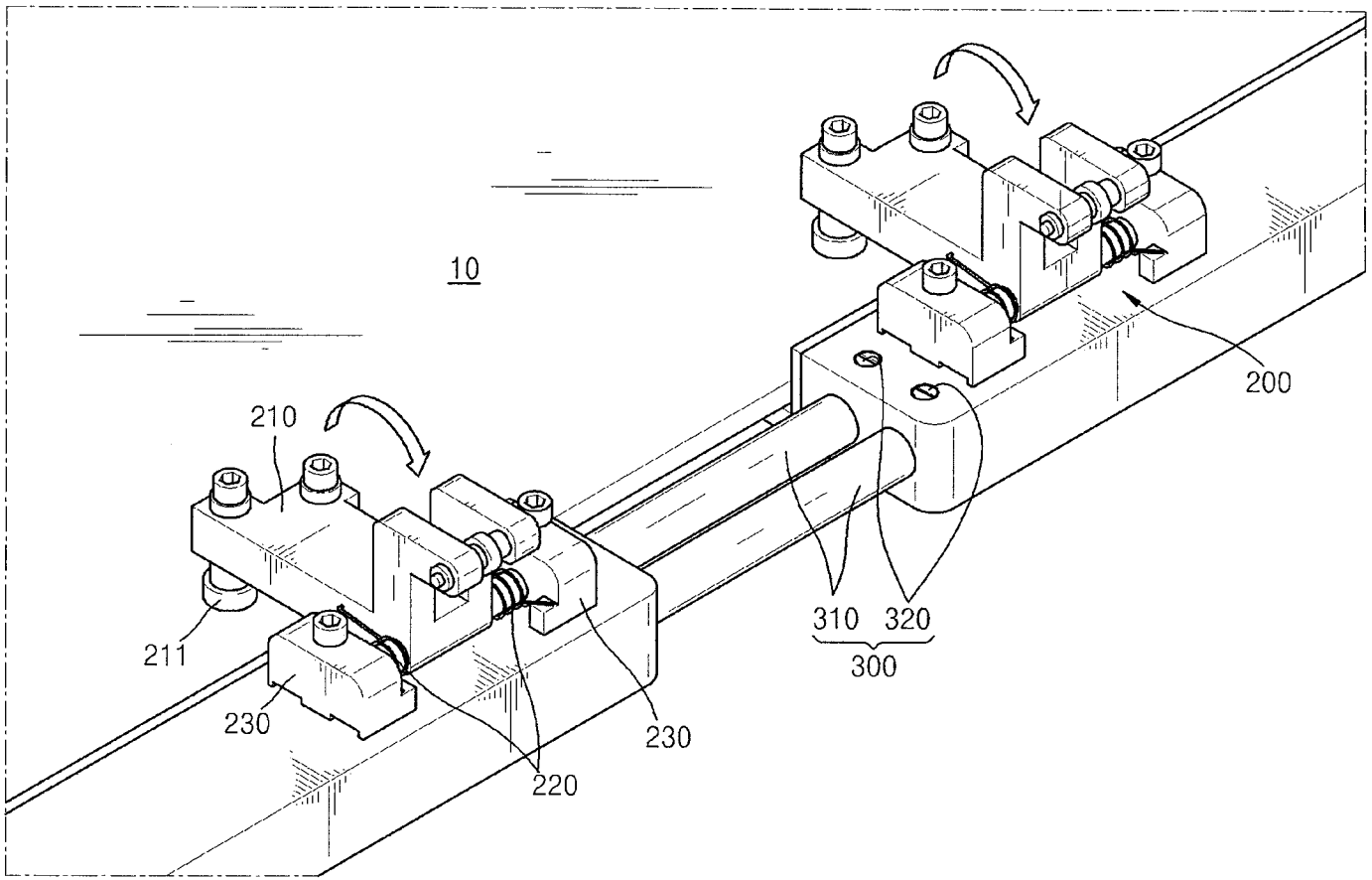
FIG. 2 is an enlarged perspective view of a clamping device included in the tray shown in FIG. 1.

The clamping devices 200 clamp the panel 10 seated on the seating portion 110 so that the panel 10 is not separated from the seating portion 110. As shown in FIG. 2, the clamping devices 200 include a push lever 210 that is rotatably disposed on a supporting block 230 formed on the frame 100 and a spring 220 for providing elastic force so that the push lever 210 presses the panel 10 in a direction of the seating portion 110. Accordingly, after seating the panel 10 on the seating portion 110 and then rotating the push lever 210, the push lever 210 presses the panel 10 toward the seating portion 110 by elastic force of the spring 220, thereby preventing the panel 10 from being separated from the seating portion 110. The clamping devices 200 are installed at a plurality of locations to secure or prevent the panel 10 from being separated from the seating portion 110. A range within which elastic force of the spring 220 acts may be designed in such a way that the push lever 210 stops when standing perpendicularly with respect to the frame 100 or that the push lever 210 falls to the opposite side at a moment when the push lever 210 exceeds a perpendicularly standing state to be tightly held (adhered) to the frame 100, like a toggle switch. In other words, if the push lever 210 may safely press the panel 10 disposed on the seating portion 110, a range within which the push lever 210 rotates may be changed freely. Reference numeral 211 denotes a pressing member contacting the panel 10, and the pressing member 211 may be formed of a flexible material, e.g., rubber.

Figure 3:
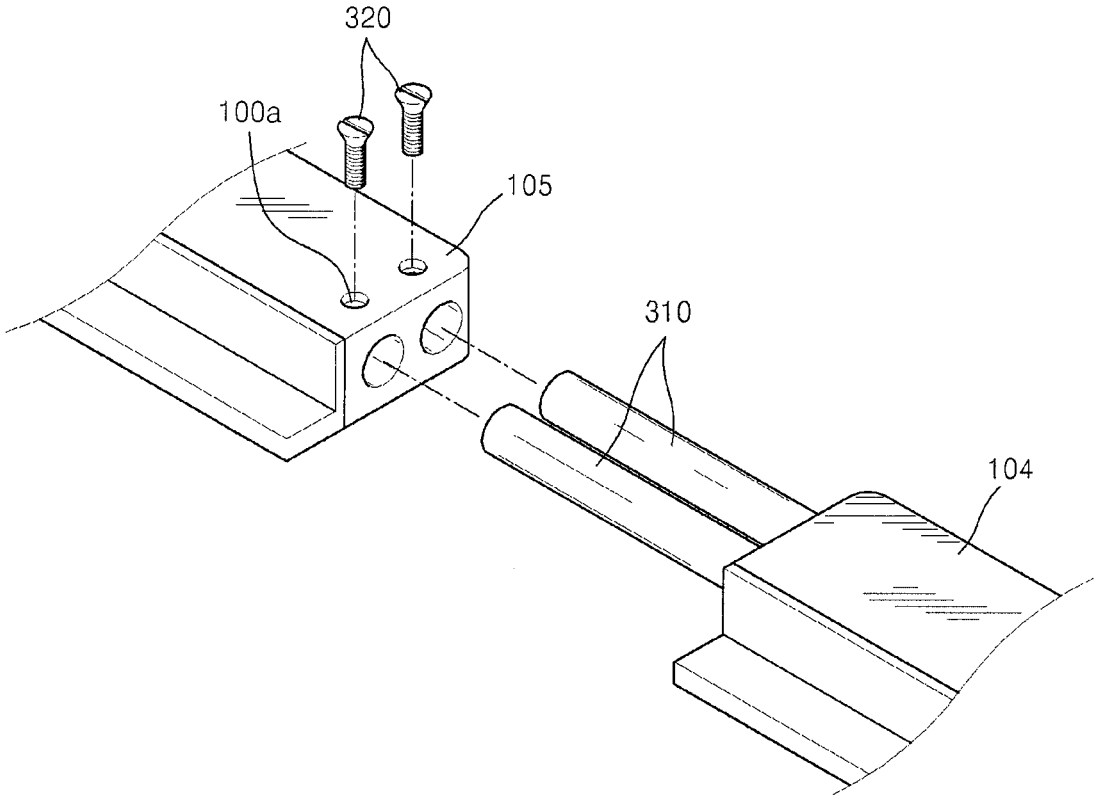
FIG. 3 is an enlarged perspective view of a size adjusting device included in the tray shown in FIG. 1.
Figure 4:
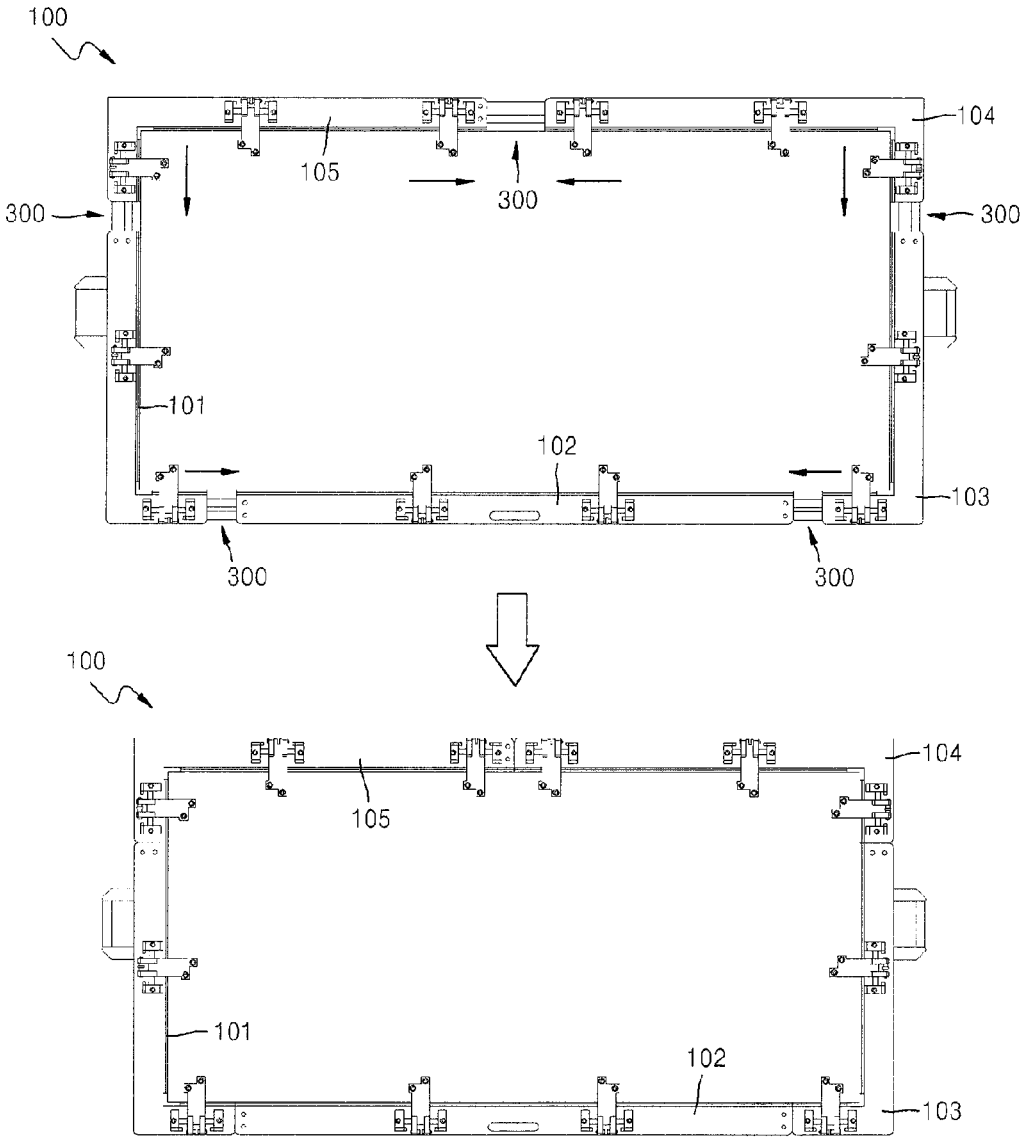
FIG. 4 is a view showing a process of changing a size of a frame by using the size adjusting device shown in FIG. 3.

Next, the size adjusting device 300, as shown in FIG. 3, includes a plurality of slide bars 310 that slidably connect the pieces 101 to 105 of the frame 100 to one another and a plurality of fasteners 320 that are compressed against the slide bars 310 via a plurality of fastener holes 100*a* formed in the pieces 101 to 105 to be fastened with the slide bars 310. In other words, an entire size of the frame 100 is adjusted by allowing the pieces 101 to 105 to approach one another or to move away from one another based on the slide bars 310, and in this state, the fasteners 320 are fastened in the fastener holes 100*a* to be fixed. Accordingly, the fasteners 320 may be loosened to gather the pieces 101 to 105 along the slide bars 310 and then to assemble the pieces 101 to 105 so that the frame 100 having a large size, as shown in an upper drawing of FIG. 4, may be changed to the frame 100 having a small size as shown in a lower drawing of FIG. 4. The upper drawing of FIG. 4 shows a maximum size of the frame 100, and the lower drawing of FIG. 4 shows a minimum size of the frame 100. The size of the frame 100 may be adjusted to correspond to various suitable sizes of the panel 10, by using the size adjusting device 300 within the maximum and minimum sizes of the frame 100.

Figure 5:
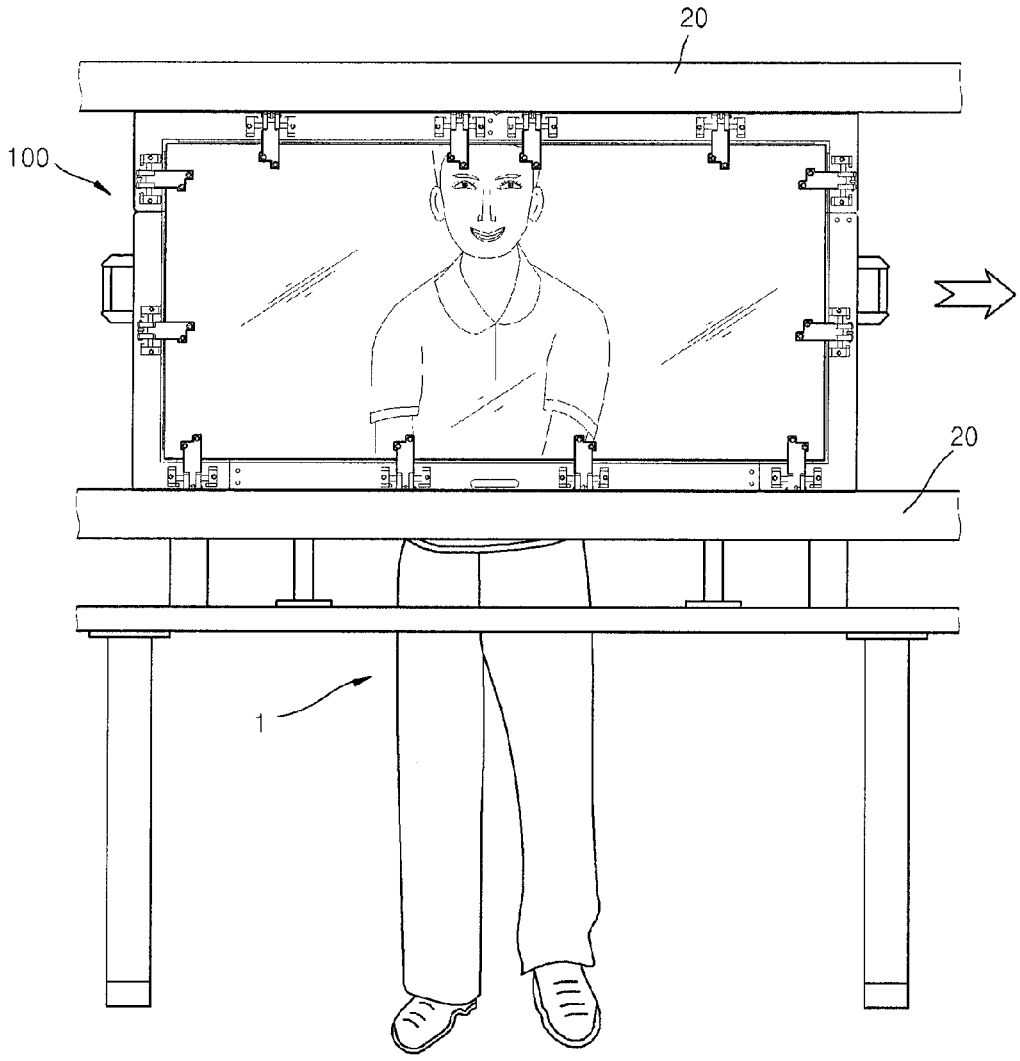
FIG. 5 is a view showing the tray of FIG. 1 that is used by a user.

The tray may be effectively used during an examination of the panel 10, as shown in FIG. 5. In other words, the panel 10 is seated on and tightly clamped to the frame 100 of which the size is adjusted to correspond to the size of the panel 10, and then the panel 10 seated on the frame 100 is moved along a transfer rail 20 used during the examination of the panel 10, and thus, a worker 1 may perform the examination. Accordingly, an OLED panel that has relatively low rigidity compared to a liquid crystal panel may be stably supported by the tray and transferred, thereby protecting the panel 10 from being damaged. Reference numeral 120 that has not been described with reference to FIG. 1 denotes a connecting portion that is electrically coupled to the panel 10 seated on the frame 100. In other words, the panel 10 seated on the frame 100 and the connecting portion 120 are electrically coupled to each other in the frame 100, and a signal line is connected to the connecting portion 120 during the examination of the panel 10 to examine a state of the panel 10. Consequently, the panel 10 may be safely handled by using the tray of the current embodiment, the panel 10 may be conveniently and rapidly examined by using the connecting portion 120, and the worker 1 may freely see front and rear surfaces of the panel 10 on the transfer rail 20. Accordingly, the examination may be effectively performed.

Hereinafter, modified embodiments of the tray according to the above-described embodiment will be described.

Figure 6:
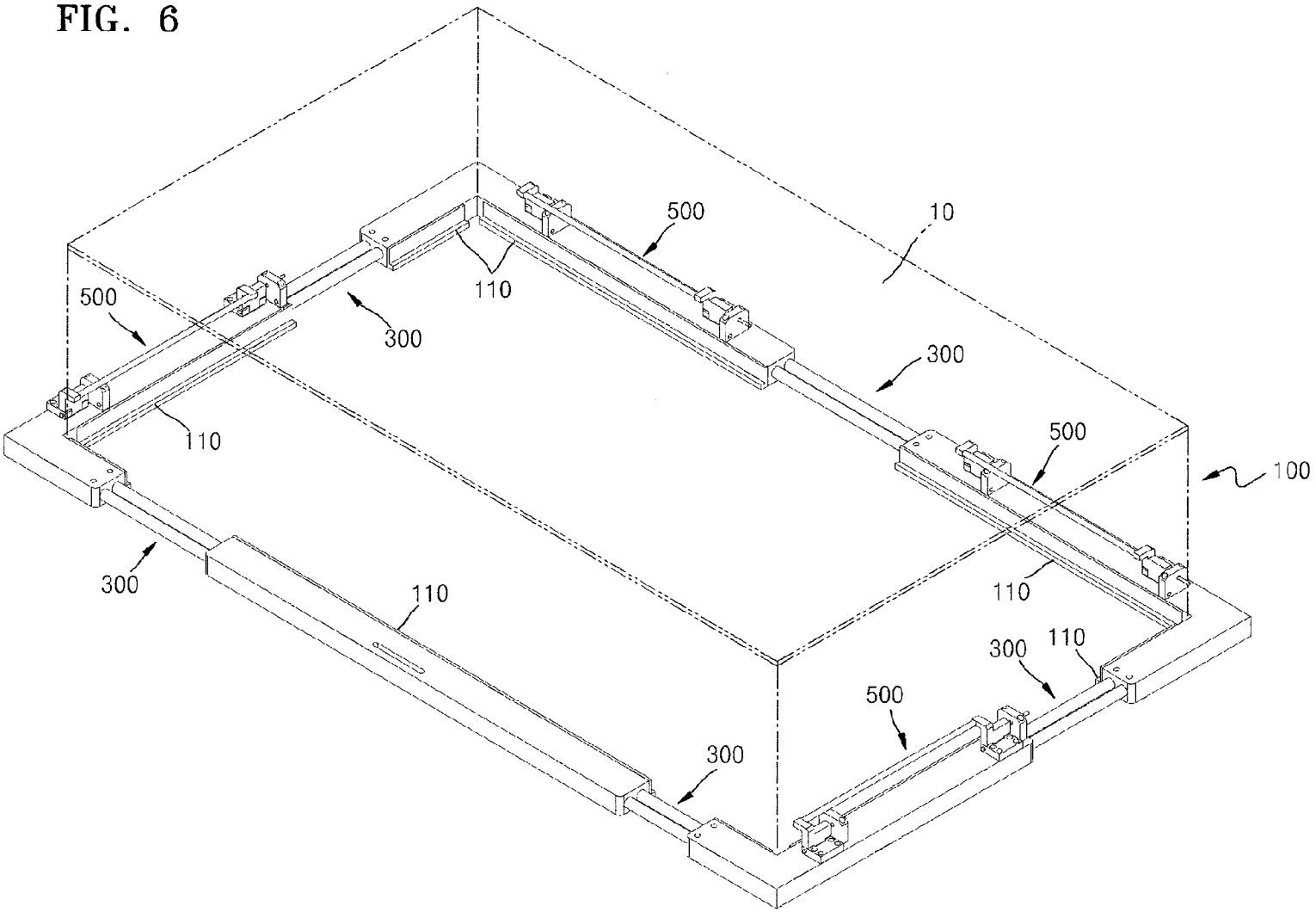
FIG. 6 is a perspective view of a tray for a flat display panel according to another embodiment of the present invention.

FIG. 6 is a perspective view of a tray for a flat display panel, according to another embodiment of the present invention. The tray of the current embodiment includes the frame 100, the size adjusting devices 300, as described above, and a plurality of clamping devices 500. Accordingly, a size of the frame 100 is adjusted to correspond to a size of the panel 10 by using the size adjusting devices 300, the panel 10 is seated on the frame 100, and the panel 10 is tightly clamped to the frame 100 by using the clamping devices 500, and thus an examination of the panel 10 is performed.

Figure 7A:
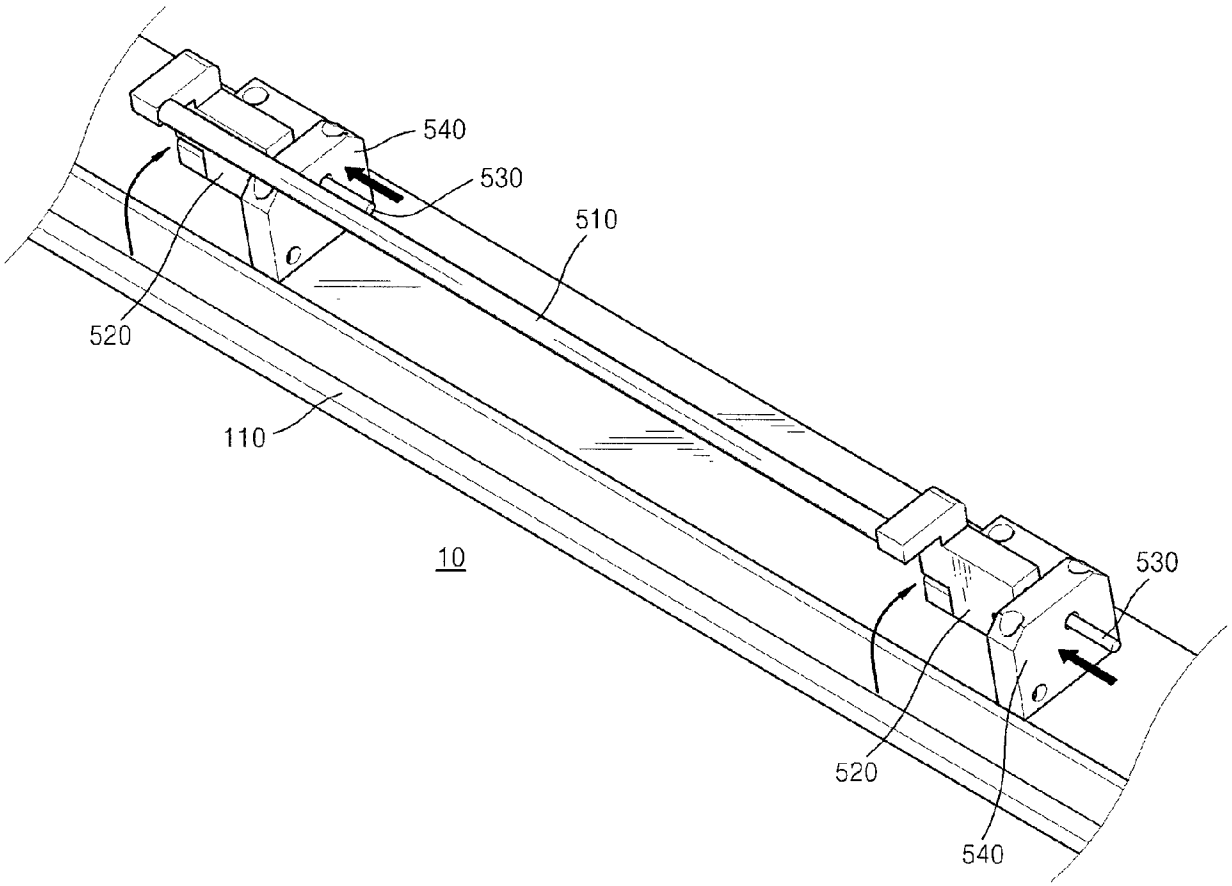
FIGS. 7A and 7B show operations of a clamping device of the tray shown in FIG. 6.
Figure 7B:
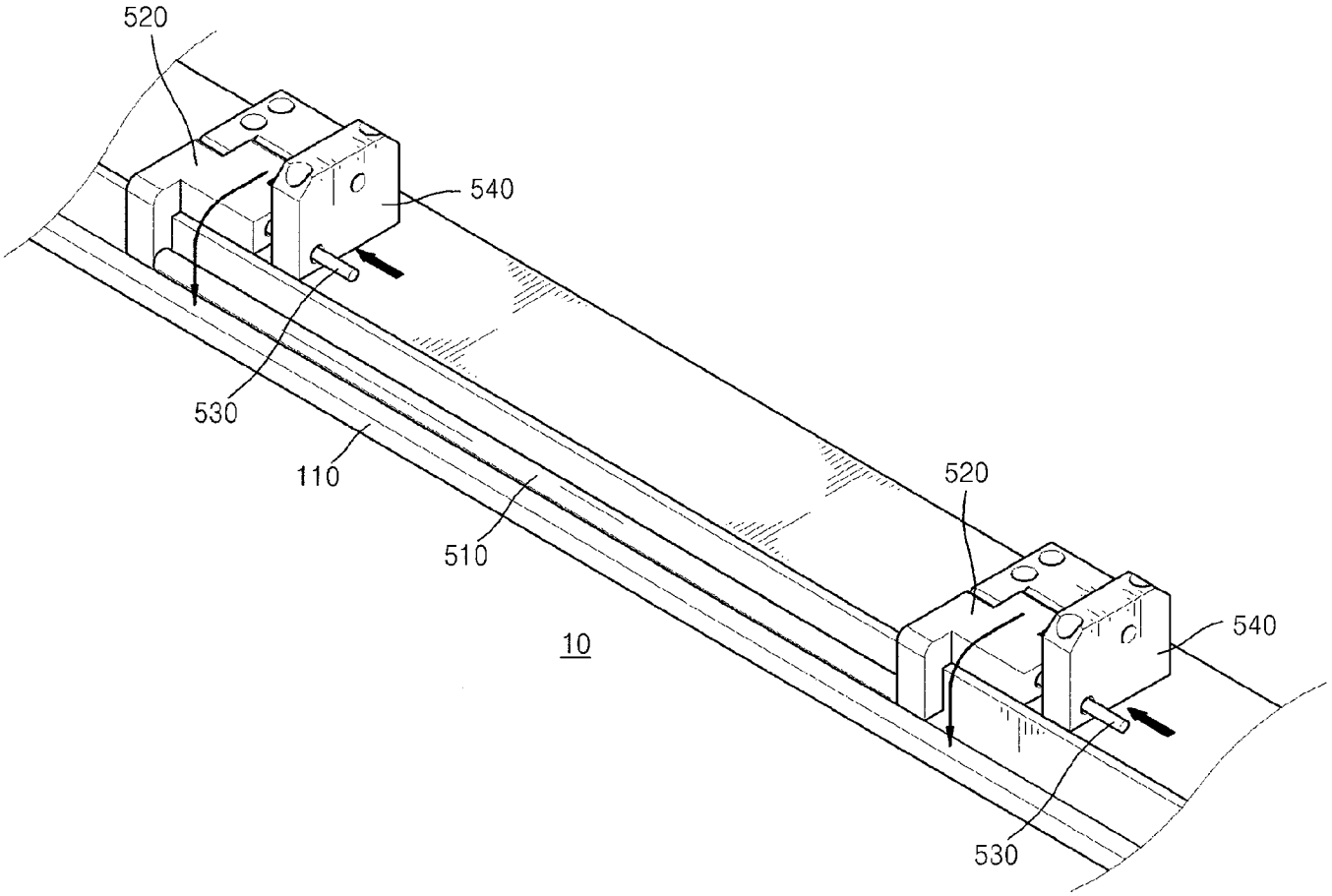

However, in the current embodiment, the clamping devices 500 are differently configured from the clamping devices 200 of the above-described embodiment. That is, in the above-described embodiment, the push lever 210 presses the panel 10 to fix the panel 10, while in the current embodiment, a push bar 510 having a long bar shape presses the panel 10 to fix the panel 10. FIGS. 7A and 7B show a structure and operations of the clamping device 500. Referring to FIGS. 7A and 7B, a pair of rotational blocks 520 are rotatably formed on the frame 100, and the push bar 510 is connected to the rotational blocks 520. Accordingly, as shown in FIG. 7A, the panel 10 is seated on a seating portion 110 when the push bar 510 is raised, and then if the rotational blocks 520 are rotated as shown in FIG. 7B, the push bar 510 presses the panel 10 to be fixed onto the seating portion 110. In this instance, since the push bar 510 should not be freely moved in an unlocked state, as shown in FIG. 7A, or in a locked state, as shown in FIG. 7B, a plurality of fixing fins 530 are inserted into the rotational blocks 520 via a plurality of fixing blocks 540, respectively, to fix the push bar 510. Accordingly, the tray of the current embodiment provides a structure in which the panel 10 may be safely and tightly supported.

Figure 8:
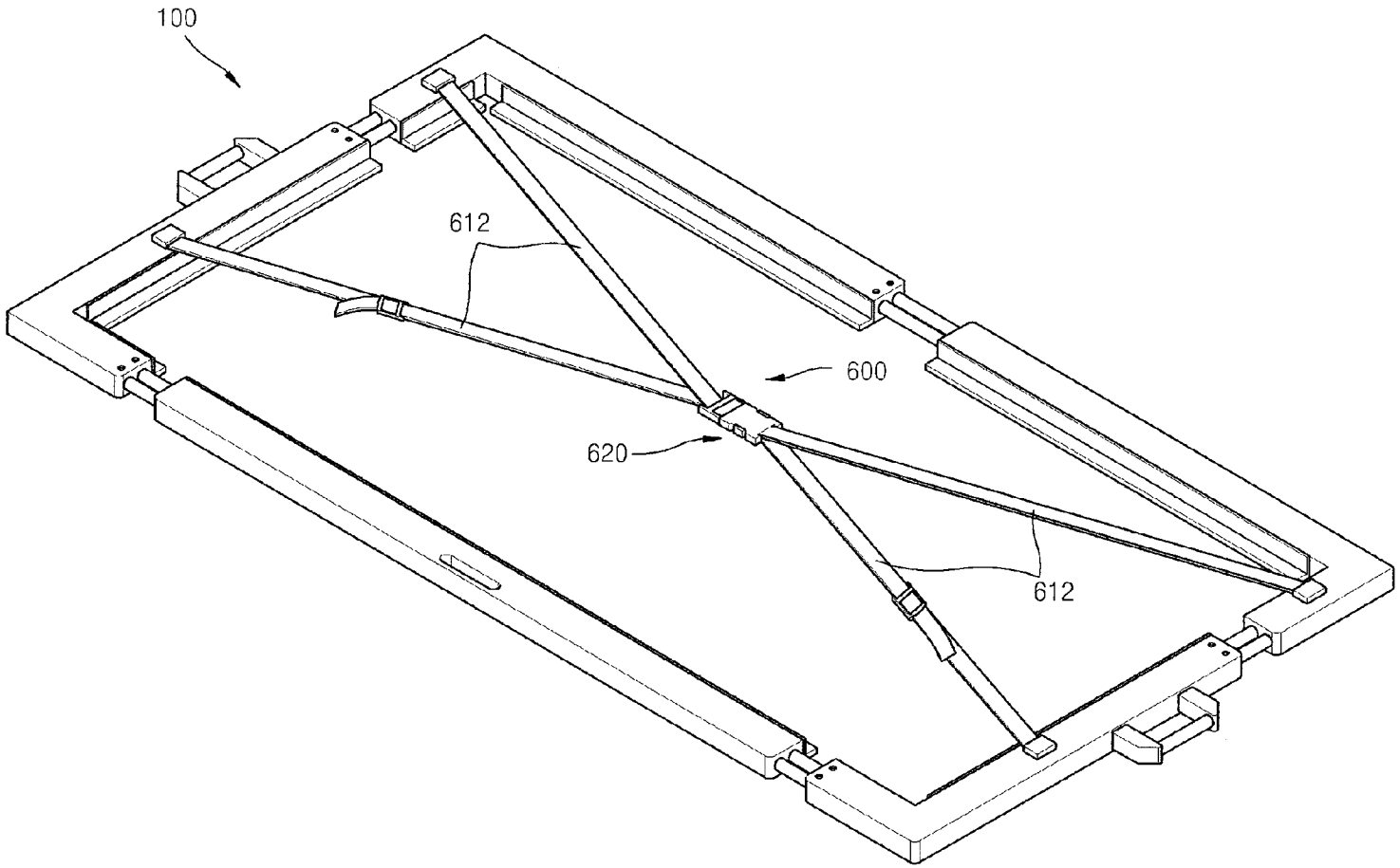
FIG. 8 is a perspective view of a tray for a flat display panel according to another embodiment of the present invention.

Next, FIG. 8 is a perspective view of a tray for a flat display panel, according to another embodiment of the present invention. A clamping device 600 of the current embodiment is differently configured from those of the above-described embodiments. In other words, in the current embodiment, a plurality of belts 612 are fastened using a fastening device 620 to fix the panel 10 instead of pressing the panel 10 by using the push lever 210 or the push bar 510 to fix the panel 10. That is, the belts 612 installed in the frame 100 are connected to each other via the fastening device 620 to be tightly held (adhered) to the panel 10 on a side of the panel 10 facing opposite away from the seating portion 110. Thus, the panel 10 is bound by the belts 612 to be supported by the belts 612 so as not to be separated from the seating portion 110. Accordingly, the panel 10 may be supported by using not only a push member, but also the belts 612.

Figure 9A:
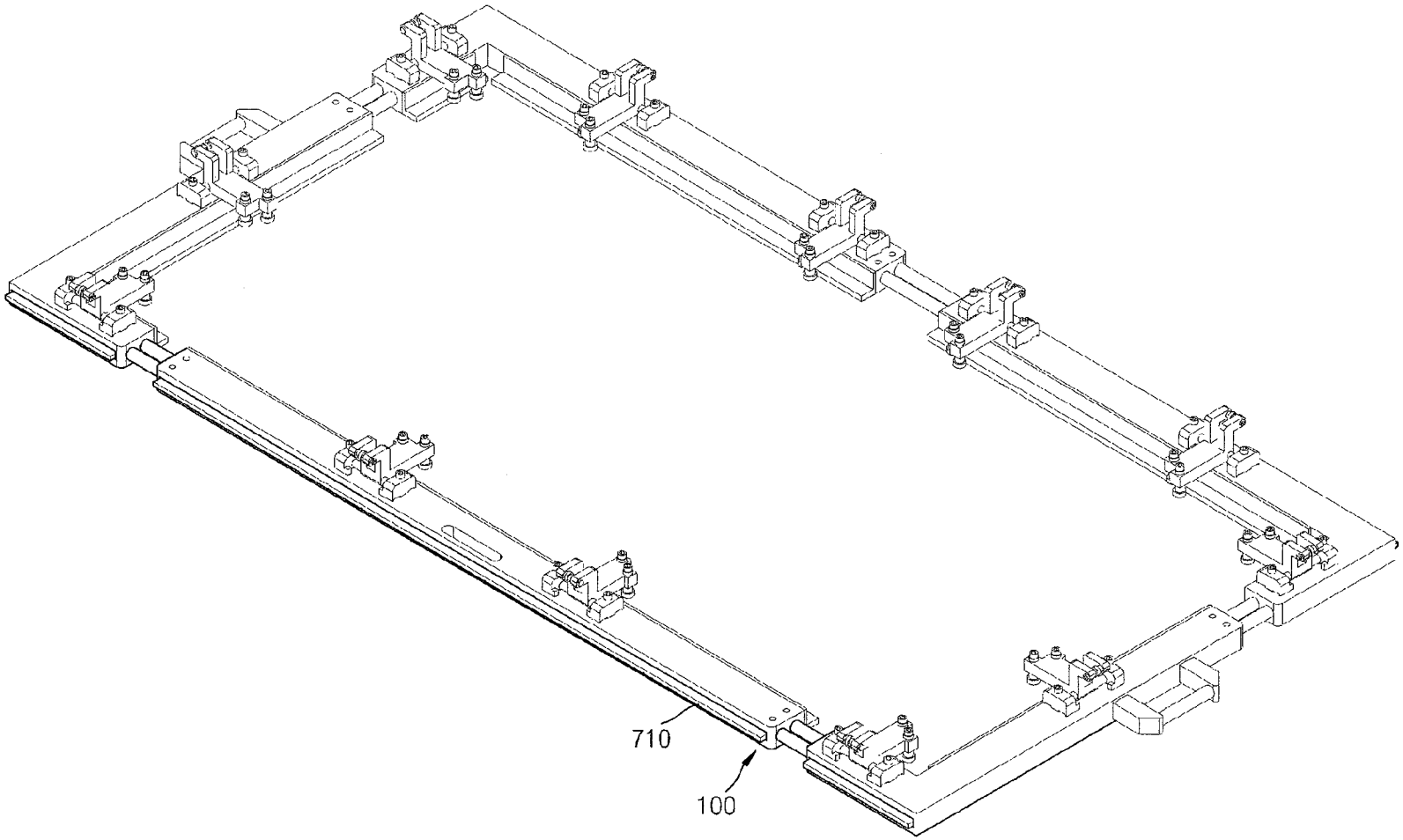
FIGS. 9A and 9B are perspective views of a tray for a flat display panel according to another embodiment of the present invention.
Figure 9B:
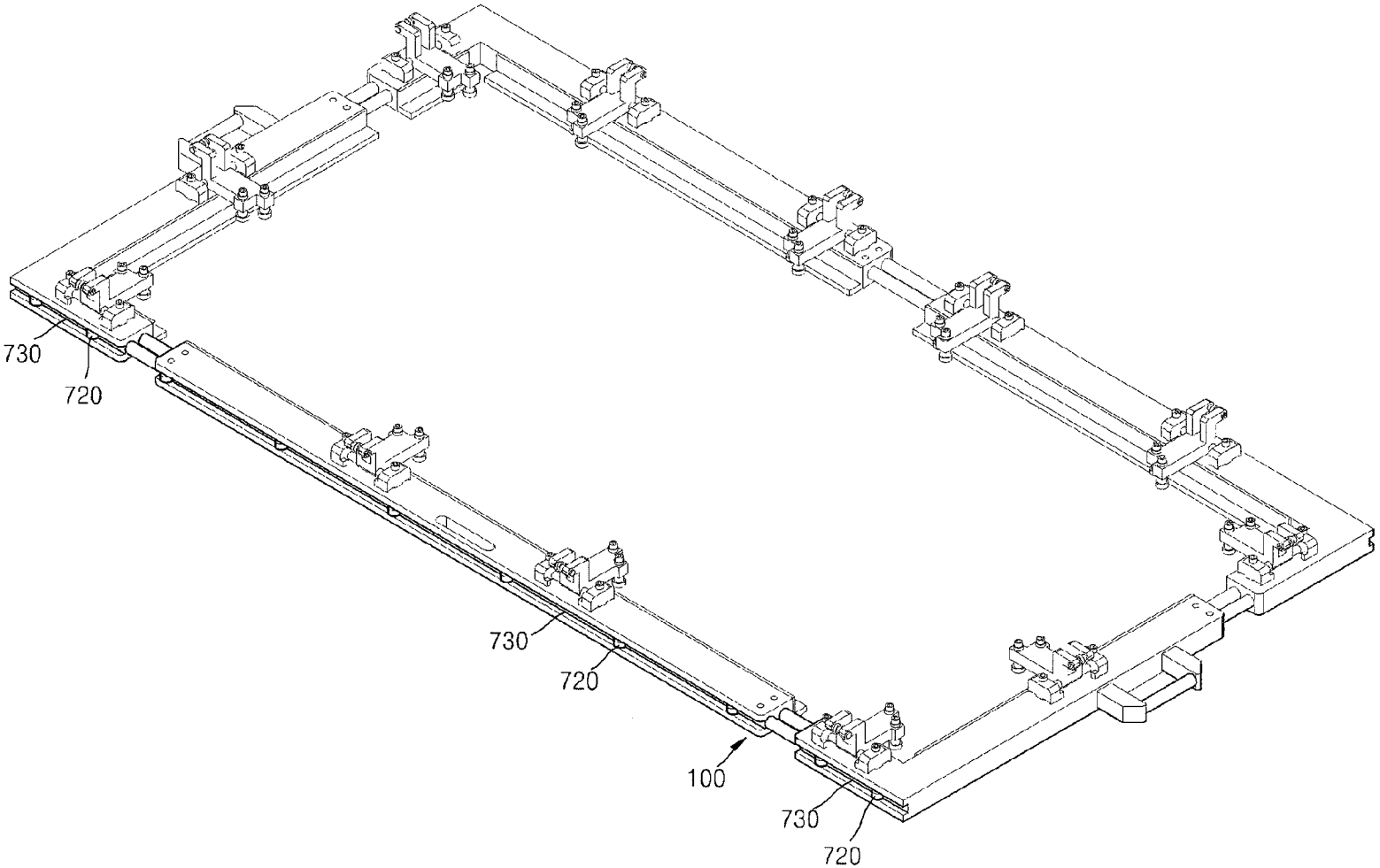

Next, FIGS. 9A and 9B are perspective views of a tray for a flat display panel, according to another embodiment of the present invention. The current embodiment exemplifies a structure in which the tray may be easily moved along the transfer rail 20 (see FIG. 5). In other words, FIG. 9A shows an upper surface of the frame 100 and FIG. 9B shows a lower surface of the frame 100. As shown in FIG. 9B, a plurality of transferring rollers 720 are installed on the lower surface of the frame 100 to move along the transfer rail 20. A plurality of slide guides 710 are installed on the upper surface opposite to the lower surface of the frame 100, as shown in FIG. 9A. Accordingly, if the transfer rail 20 is formed to match with the slide guides 710 and the transferring rollers 720, the panel 10 may be smoothly moved to be examined by using the tray of the current embodiment.

Figure 10:
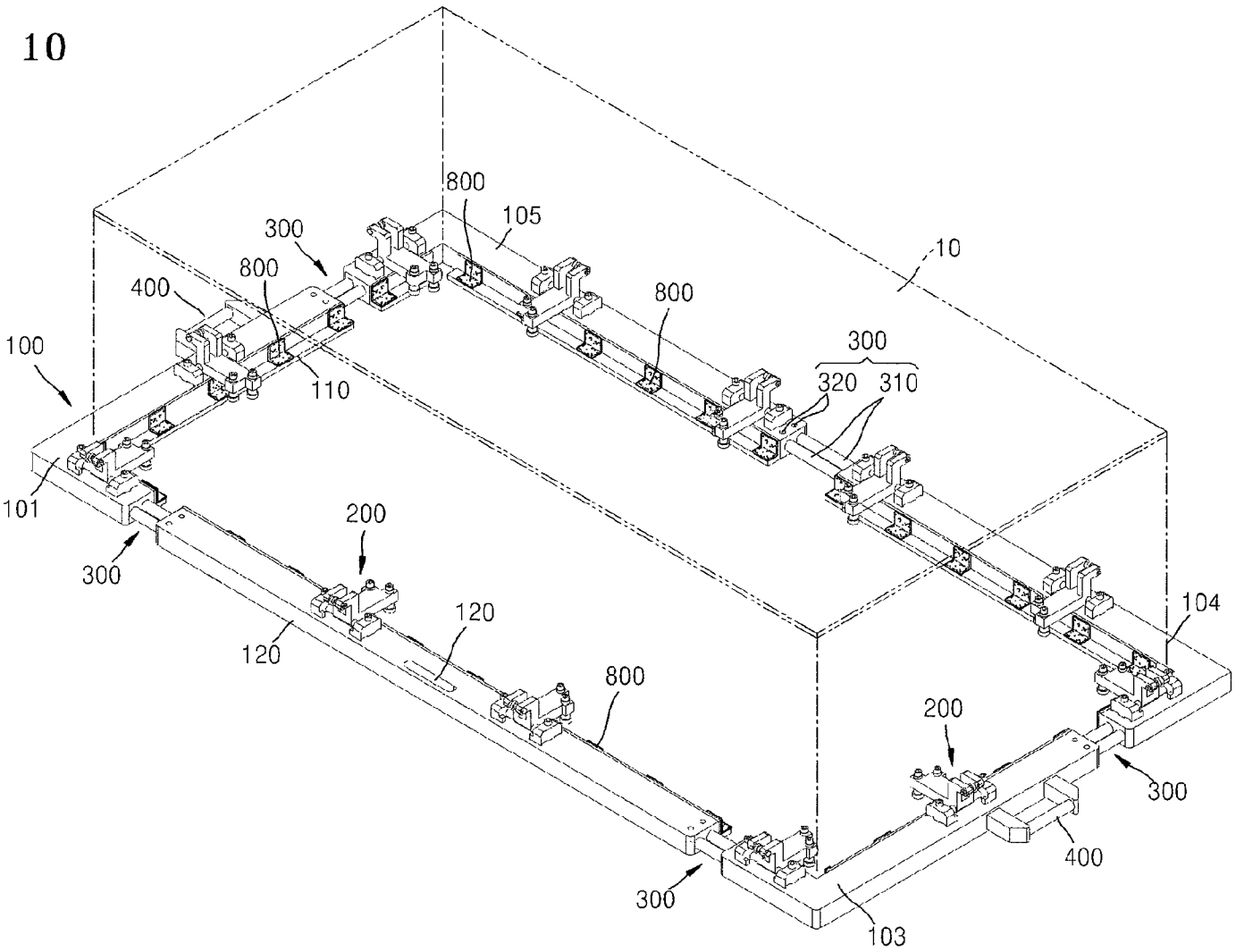
FIG. 10 is a perspective view of a tray for a flat display panel according to another embodiment of the present invention.

FIG. 10 is a perspective view of a tray for a flat display panel, according to another embodiment of the present invention. The tray of the current embodiment has a structure in which a plurality of bumping members 800 are installed in the seating portion 110 of the frame 100. In other words, an edge portion of the panel 10 contacts the frame 100, and the edge portion of the panel 10 may often collide with the frame 100 during handling of the tray, and thus, a contact portion between the edge portion of the panel 10 and the frame 100 may be damaged. Accordingly, the bumping members 800 may be installed on the contact portion to cushion the impact. The bumping members 800 may be formed of urethane or silicon. Thus, according to the current embodiment, the panel 10 may be safely supported to prevent damage due to impact.

A plurality of handles 400 may be installed on all the above-described frames 100, as shown in FIG. 1, to facilitate handling of the trays.

While the present invention has been particularly shown and described with reference to exemplary embodiments thereof, it will be understood by those of ordinary skill in the art that various changes in form and details may be made therein without departing from the spirit and scope of the present invention as defined by the following claims, and equivalents thereof.

What is claimed is:

1. A tray for a flat display panel, the tray comprising:

a frame comprising a seating portion configured on which the flat display panel sits and a plurality of pieces, ones of the plurality of pieces connected to other ones of the plurality of pieces;

a clamping device for clamping the panel so as not to be separated from the seating portion;

a size adjusting device for adjusting a size of the frame to correspond to a size of the flat display panel, the size adjusting device comprising a plurality of slide bars for allowing adjacent ones of the plurality of pieces to approach one another or to move away from one another, at least one slide bar being at each side of the frame; and a fastening device for coupling one of the plurality of pieces to a corresponding slide bar of the plurality of slide bars, a circumference of an end of each of the plurality of slide bars being completely surrounded by a corresponding one of the plurality of pieces, wherein more of the plurality of slide bars are at a side of the frame than are at another side of the frame, and wherein the clamping device comprises a push lever rotatably installed on the frame and configured to rotate along an axis that is parallel to one side of the slide bars, and a spring for providing elastic force so that the push lever presses the panel in a direction of the seating portion.

2. The tray of claim 1, wherein a plurality of bumping members are each installed at a contact portion between an edge portion of the panel and the frame.

3. The tray of claim 2, wherein the bumping member comprises at least one selected from the group consisting of urethane and silicon.

4. The tray of claim 1, wherein the fastening device has a plurality of fastener holes formed in the pieces and a plurality of fasteners for inserting into the fastener holes to be compressed against the slide bars.

5. The tray of claim 1, wherein a plurality of transferring rollers are on at least one surface of the frame to move along a transfer rail.

6. The tray of claim 5, wherein a plurality of slide guides are on a surface facing the transferring rollers of the frame to be slidably coupled to the transfer rail.

7. The tray of claim 1, wherein a connecting portion is installed in the frame to electrically couple the panel and a detachable signal line.

8. The tray of claim 1, further comprising a plurality of handles on the frame.

9. The tray of claim 1, wherein the plurality of slide bars are in pairs in the respective pieces; and the slide bars are rods.

* * * * *